US005776007A

United States Patent [19]

Kendall et al.

[11] Patent Number: 5,776,007

[45] Date of Patent: Jul. 7, 1998

[54] PUTTING PRACTICE DEVICE

[75] Inventors: George Kendall, P.O. Box 9132, Rancho Santa Fe, Calif. 92067; Horacio Yrueta, Rancho Santa Fe, Calif.; John Bearden, San Leandro, Calif.

[73] Assignee: George Kendall, Rancho Santa Fe, Calif.

[21] Appl. No.: 622,377

[22] Filed: Mar. 27, 1996

[51] Int. Cl.[6] ..... A63B 69/36

[52] U.S. Cl. ..... 473/258; 473/174; 473/176; 473/185; 473/220; 473/221; 473/268; 473/261; 473/260; 473/409; 248/176

[58] Field of Search ..... 473/195, 220, 473/225, 222, 258, 261, 174, 176, 185, 221, 268, 409

[56] References Cited

U.S. PATENT DOCUMENTS

| | | | |
|---|---|---|---|
| 1,545,648 | 7/1925 | Fletcher | 473/258 |
| 2,303,736 | 12/1942 | Hall | 473/258 |
| 4,082,287 | 4/1978 | Berkey | 473/261 |
| 4,334,684 | 6/1982 | Sterling | 473/261 X |
| 5,273,284 | 12/1993 | Montgomery | 473/258 |
| 5,527,041 | 6/1996 | Terry et al. | 473/220 X |
| 5,586,945 | 12/1996 | Vonderhaar | 473/261 |

*Primary Examiner*—George J. Marlo
*Attorney, Agent, or Firm*—Lyon & Lyon LLP

[57] ABSTRACT

A device and method for improving the putting of a golf ball is described herein. The instructional device employs a sighting member and a shaft guide to assist in aligning and stroking a golf putt. The device is configured such that a golfer or instructor may develop each putting skill independently or in combination with the other skills. The device comprises two stands, set apart, with the sighting member attached to the top of each stand. A square face indicator may be positioned perpendicular to the sighting member, and the shaft guide may couple to a side of the stands. A method for improving the putting of a golf ball is also described herein, where the method addresses finding and verifying a sight line that extends from a golf ball to a desired target, aligning a golf putter face squarely to said sight line, and moving a putter shaft parallel to said sight line.

6 Claims, 6 Drawing Sheets

FIG. 1
FIG. 2
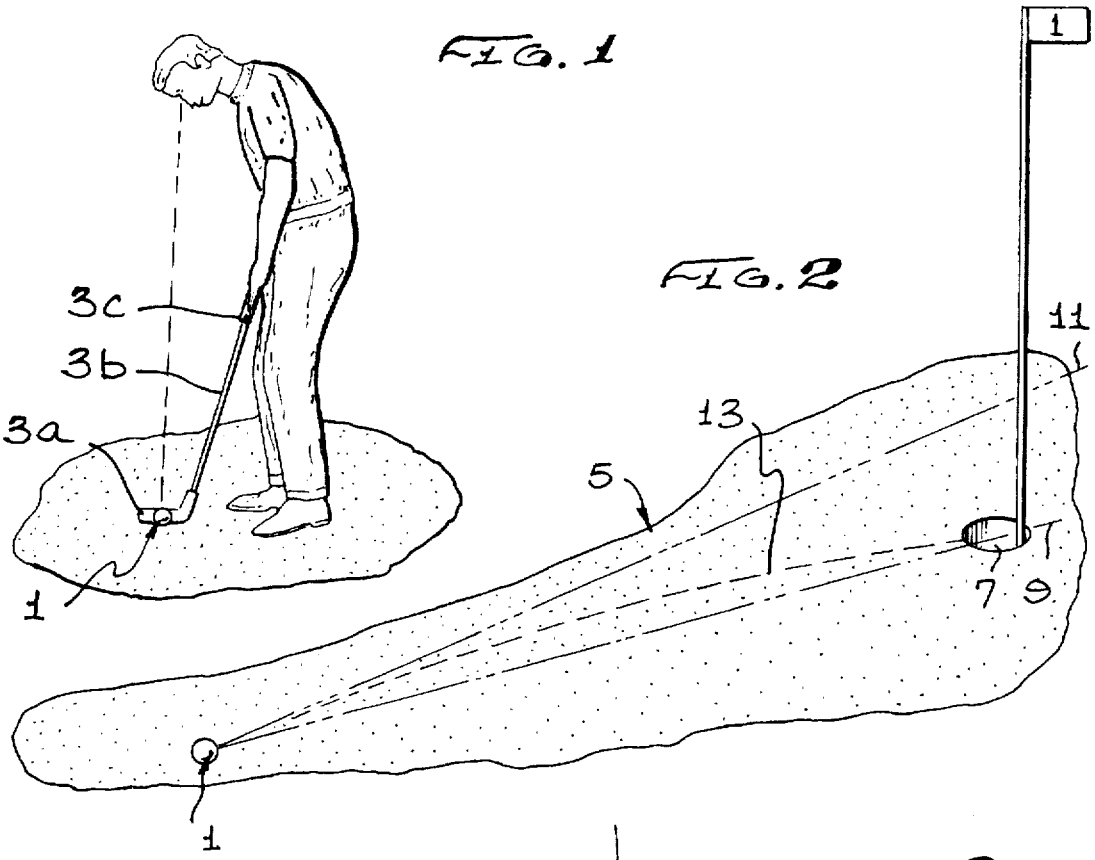
FIG. 3
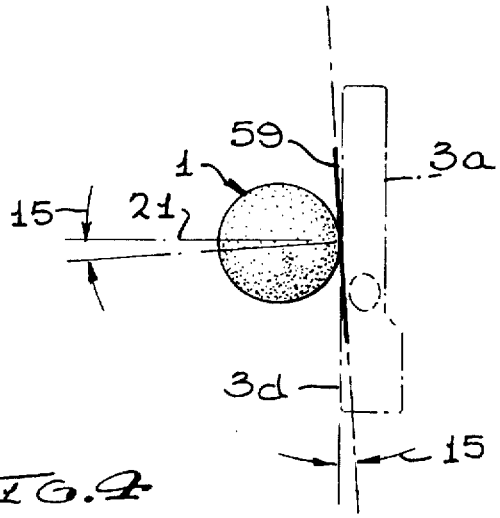
FIG. 4
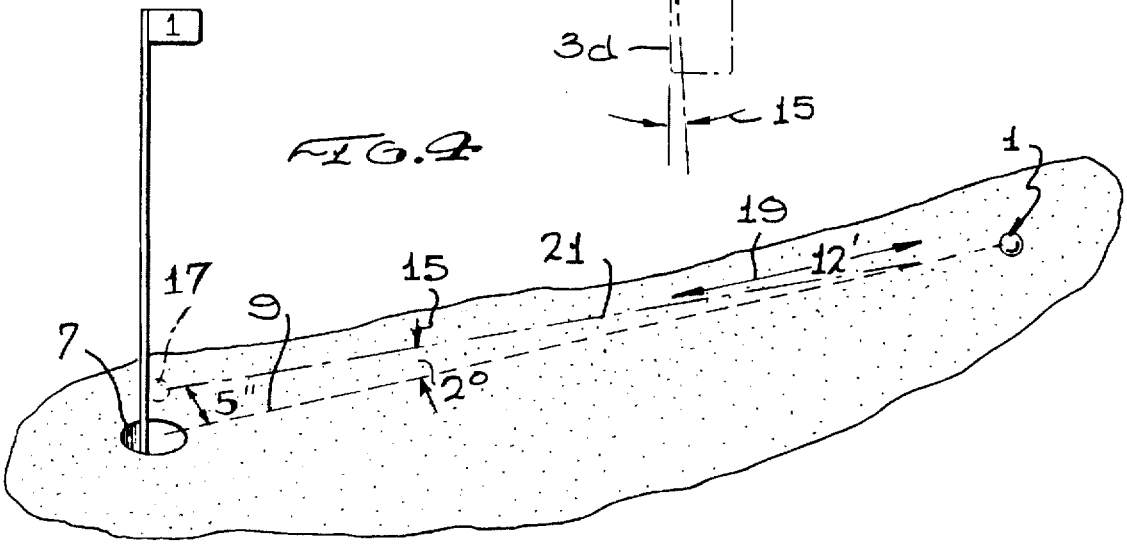

FIG. 7a
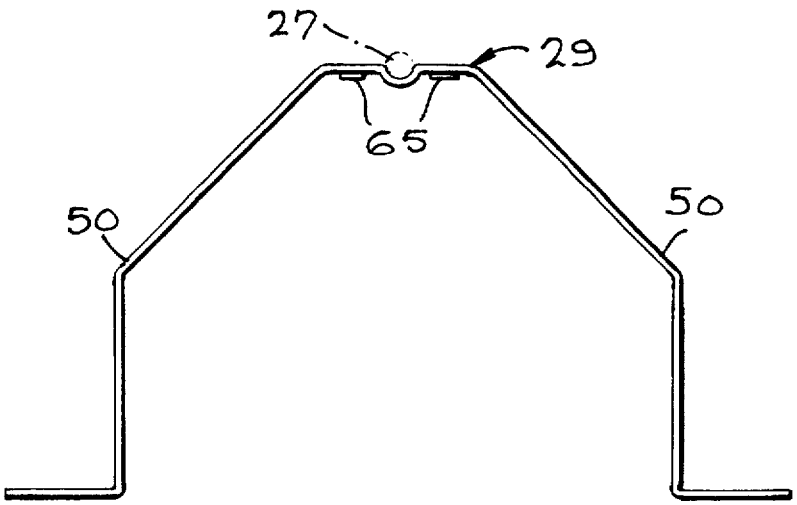
FIG. 7b
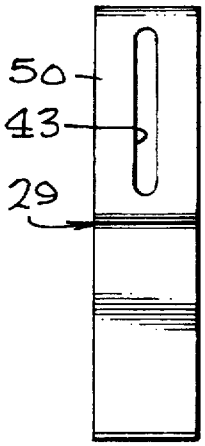
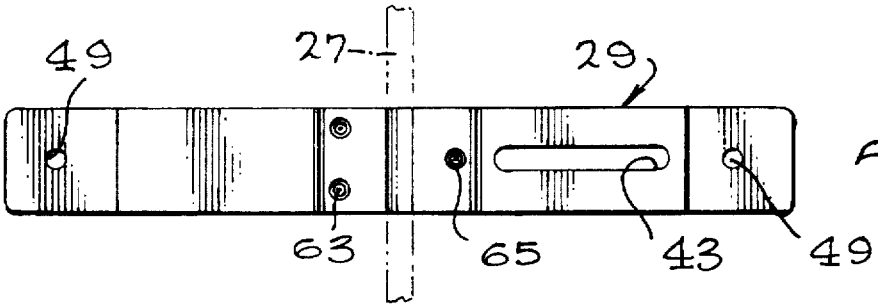
FIG. 7c
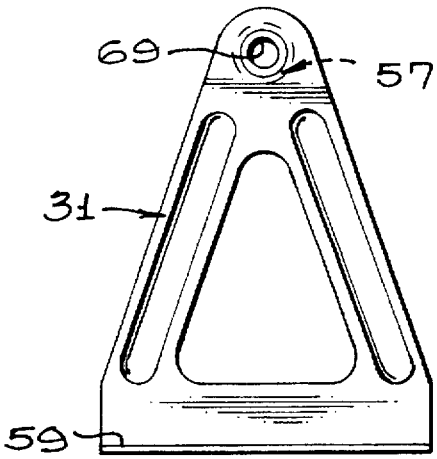
FIG. 8a
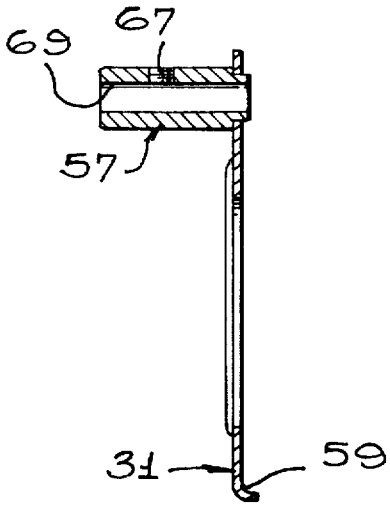
FIG. 8b FIG. 8c
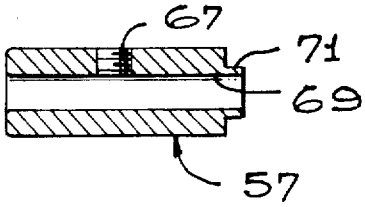
FIG. 10
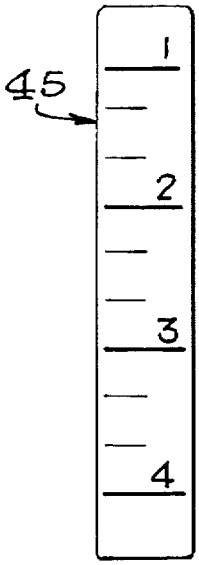
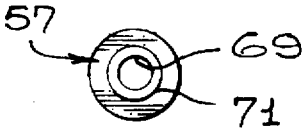
FIG. 8d
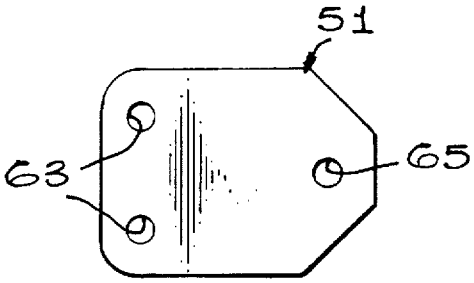
FIG. 9
FIG. 11a
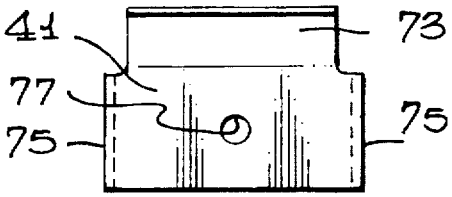
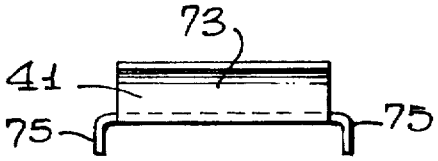
FIG. 11b
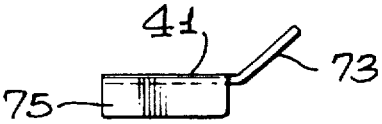
FIG. 11c
FIG. 12a
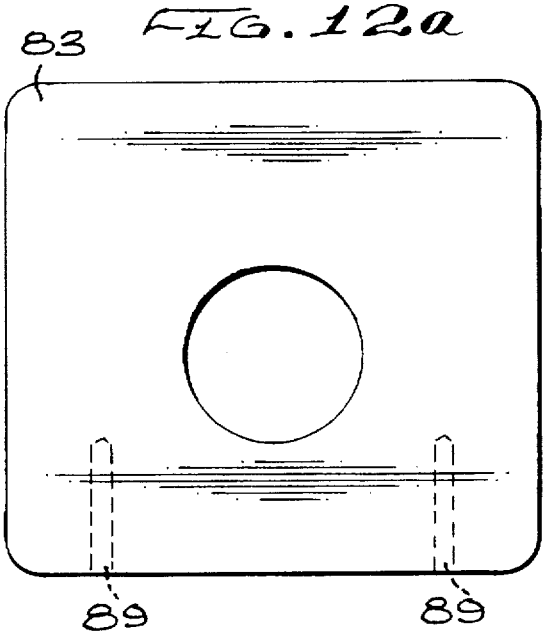
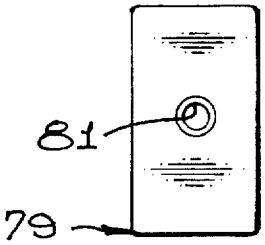
FIG. 11d FIG. 13a
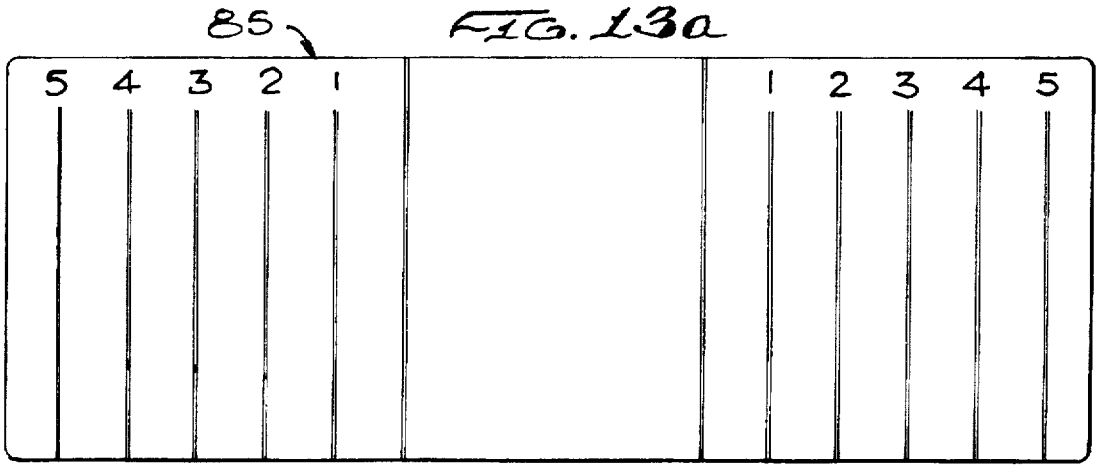
FIG. 13b
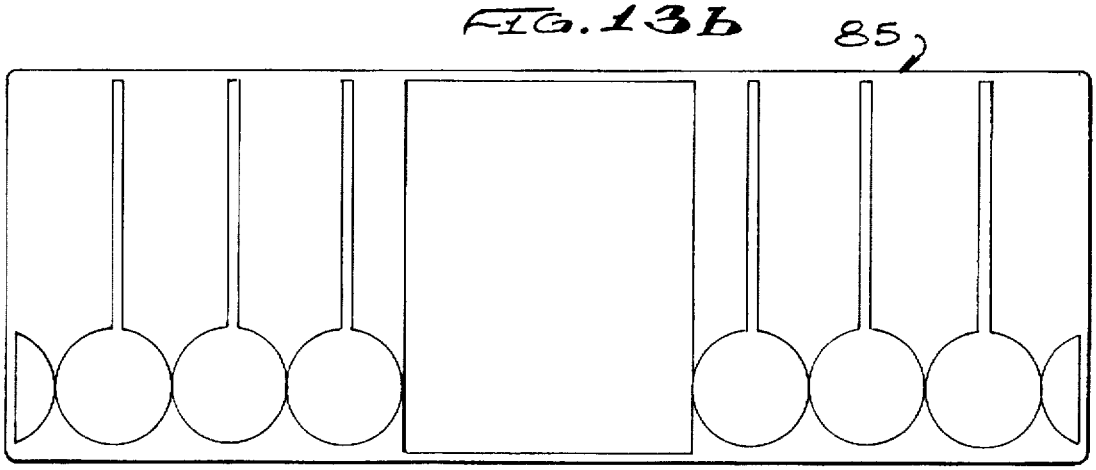
FIG. 12b
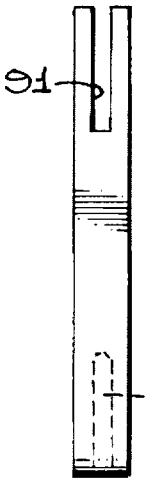
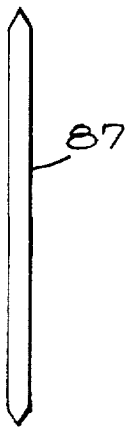
FIG. 12c
FIG. 14a
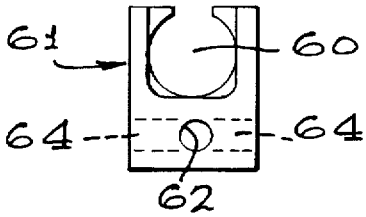
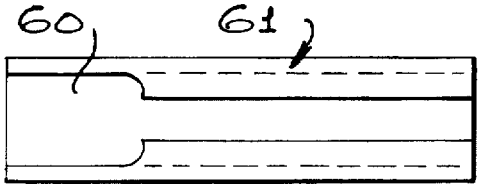
FIG. 14b

PUTTING PRACTICE DEVICE

FIELD OF THE INVENTION

The field of the present invention is mechanical instruction devices and methods for golf putting.

BACKGROUND OF THE INVENTION

As golfers are well aware, almost as many (and sometimes more) strokes are expended putting in a round of golf as on the tee-off and fairway shots. Yet typically, golfers spend much more time on practicing their tee-off and fairway shots than improving their putting ability. Since the tee-off and fairway shots are typically longer, power hits, the self-satisfaction gained by hitting balls on a practice range farther far exceeds the comparably mundane activity of gently stroking a golf ball into a hole just a few feet away. Since putting ability is key to a successful round of golf, but golfers are likely to spend only a limited time in improving their putting, it is necessary that putting improvement time be as useful and productive as possible. Golfers will sometimes practice putting on their own, but, because the art of putting is so difficult, they will often take group classes or hire a professional tutor. The instructor or tutor is often a golf professional hired to assist in the functioning of a golf course. These professional golfers, or pros, often make a significant portion of their income by providing lessons, including putting instruction, to golfers. Although there may be some disagreement on specifics, most pros would agree that these four basic skills are necessary to a good putting stroke:

1. A first skill in proper putting is to sight an imaginary line between the golf ball and the cup. Referring to FIG. 2, the player must envision a straight line 9 and 11 along which the ball must be initially propelled if it is to end up in the cup. This imaginary line from the ball may be a direct line 9 to the cup or an indirect line 11 aimed right or left of the cup, depending upon other factors such as slope of the green, wind speed, grain of the grass, moisture, etc., that are beyond the player's control. It is important to note that this line must be defined even if the ball is expect to roll on an irregular path, or break, to the cup. Once the golfers have visualized this imaginary line, they may go to the next skill.
2. The golfer's position in relation to the golf ball is called the golfer's "address" to the ball. At address of the putt, the player's head must be directly over the ball. The eyes must look vertically down as shown in FIG. 1, for this is the only eye position that will minimize parallax deception, thus minimizing the distortion between the actual sight line and the sight line as seen by the golfer. The player's head and eyes must remain in this position during the entire putting stroke. Generally, the putting stroke can be divided into three phases: the line-up, where the putter head is placed stationary just behind the golf ball; the take away, where the putter is drawn away from the ball; and the strike, where the putter head contacts the golf ball and the momentum of the putter head carries it beyond the original position of the ball. When properly addressed to the ball, the golfer then concentrates on correctly positioning the putter face of the putter in relation to the sight line.
3. The putter face of the putter must be oriented at a right angle, or square, to the imaginary line as established above when the putter face strikes the golf ball. As shown in FIG. 4, a deviation of the putter face by only 2° from square results in an off-line putt of over 2" in a 5 foot putt or more than 5" in a 12 foot putt. Since the cup is only 4½" in diameter, a 5 foot putt thought to be directed to the center of the cup would end up on the edge, and a 12 foot putt would miss the cup entirely. FIGS. 3 and 4 illustrate graphically the difficulty in discerning such a slight variation as 2 degrees from square. Here, the golfer has sighted a direct line 9 to the cup and is attempting to square the putter face **3*d* to this line. Unfortunately, the golfer has placed the putter head so the square to the putter face 3*d* is represented by misalignment line 21. Although the angle of misalignment is only 2 degrees, which is barely noticeable by viewing the putter head, the ball 1 will end up at missed position 17, missing the cup 7** by over 5 inches in just a 12 foot putt. When the golfer has correctly squared the putter face to the sight line, the golfer is then ready to strike the ball with the putter face square to the imaginary line.
4. The putter face of the putter must not only be square to the imaginary sight line as it contacts the ball, but the putter shaft must move parallel to the same imaginary line as well. When the putter face contacts the ball squarely but with the shaft not moving parallel to the line, either a clockwise or counterclockwise spin will be imparted, causing the ball to curve away from the intended line.

For a proper golf putt, then, the golfer must master four basic skills: 1) properly sight an imaginary line; 2) correctly address the ball; 3) squarely strike the ball in relation to the imaginary line; and 4) squarely move the putter shaft parallel to the imaginary line. Because the golfer must simultaneously and properly perform so many skills for the putt to go where intended, it is easy for the golfer to get discouraged while learning or practicing. What is needed is a practice or teaching tool that allows a golfer to learn, practice and internalize each step individually. Although there are instructional putting tools available that address some of the skills discussed above, none allow each of the four necessary putting skills to be addressed individually using one device. Additionally, as skills are internalized, the device allows the skills to be combined to develop the entire putting stroke.

SUMMARY OF THE INVENTION

The invention is directed toward improving a golfer's ability to putt by assisting in building confidence and improving execution in the basic skills necessary to a successful golf putt.

In a first, separate aspect of the present invention, two stands are arranged with a sight member and a shaft guide extending therebetween. Alignment of the assembly and guidance for a golf putter are thus provided.

In a second, separate aspect of the present invention, a stand supports a sight member and a shaft guide whereby alignment of the assembly and guidance for a golf putter is provided.

In a third, separate aspect of the invention, a square face indicator is coupled to a sight member for alignment of a putter face.

In another separate aspect of the invention, a laser pointer that emits a visible laser beam is coupled to a sight member so said laser beam is in the same vertical plane as said sight member.

In yet another separate aspect of the invention, a sighting target is placed remote from a sight member such that said sighting target may intersect the vertical plane containing said sight member.

In a further separate aspect of the invention, a golfer or instructor aligns a sight member to a target, verifies the correctness of the line, positions a putter head square to said sight member, and strokes the putter shaft parallel to said sight member.

BRIEF DESCRIPTIONS OF THE DRAWINGS

FIG. 1 shows a golfer properly addressing a golf ball.

FIG. 2 shows a direct and an indirect imaginary line from the golf ball to the cup.

FIG. 3 shows a putter face misaligned to the square of the imaginary line.

FIG. 4 shows how a misalignment of only 2 degrees will cause the ball in a 12 foot putt to miss the cup by over 5 inches.

FIG. 7*a* is a side view of a stand for the preferred embodiment.

FIG. 7*b* is a front view of a stand for the preferred embodiment.

FIG. 7*c* is a top view of a stand of the preferred embodiment.

FIG. 8*a* shows a side view of the square face indicator.

FIG. 8*b* shows a front view of the square face indicator.

FIG. 8*c* is a front view of the square face indicator hub.

FIG. 8*d* is a side view of the square face indicator hub.

FIG. 9 is a top view of a sight rod clamp.

FIG. 10 is a front view of the shaft guide position indicator.

FIG. 11*a* shows a front view of the guide clip.

FIG. 11*b* shows a bottom view of the guide clip.

FIG. 11*c* shows a side view of the guide clip.

FIG. 11*d* shows a front view of the guide clip nut plate.

FIG. 12*a* shows a side view of the sight stand.

FIG. 12*b* shows a front view of the sight stand.

FIG. 12*c* shows a sight stand post

FIG. 13*a* shows detail of the front side of the sight target, showing a sighting pattern in inches.

FIG. 13*b* shows detail of the back side of the sight target, which is an alternate sighting pattern in ball diameters.

FIG. 14*a* shows a top view of the laser pointer holder.

FIG. 14*b* shows a front view of the laser pointer holder.

DESCRIPTION OF THE PREFERRED EMBODIMENT

The preferred embodiment contains elements that instruct in each of the four skills identified above: sighting, addressing, squaring the face, and squaring the stroke. Elements directed toward each skill will first be generally discussed, and then detail will be added in later sections.

Figure 5:
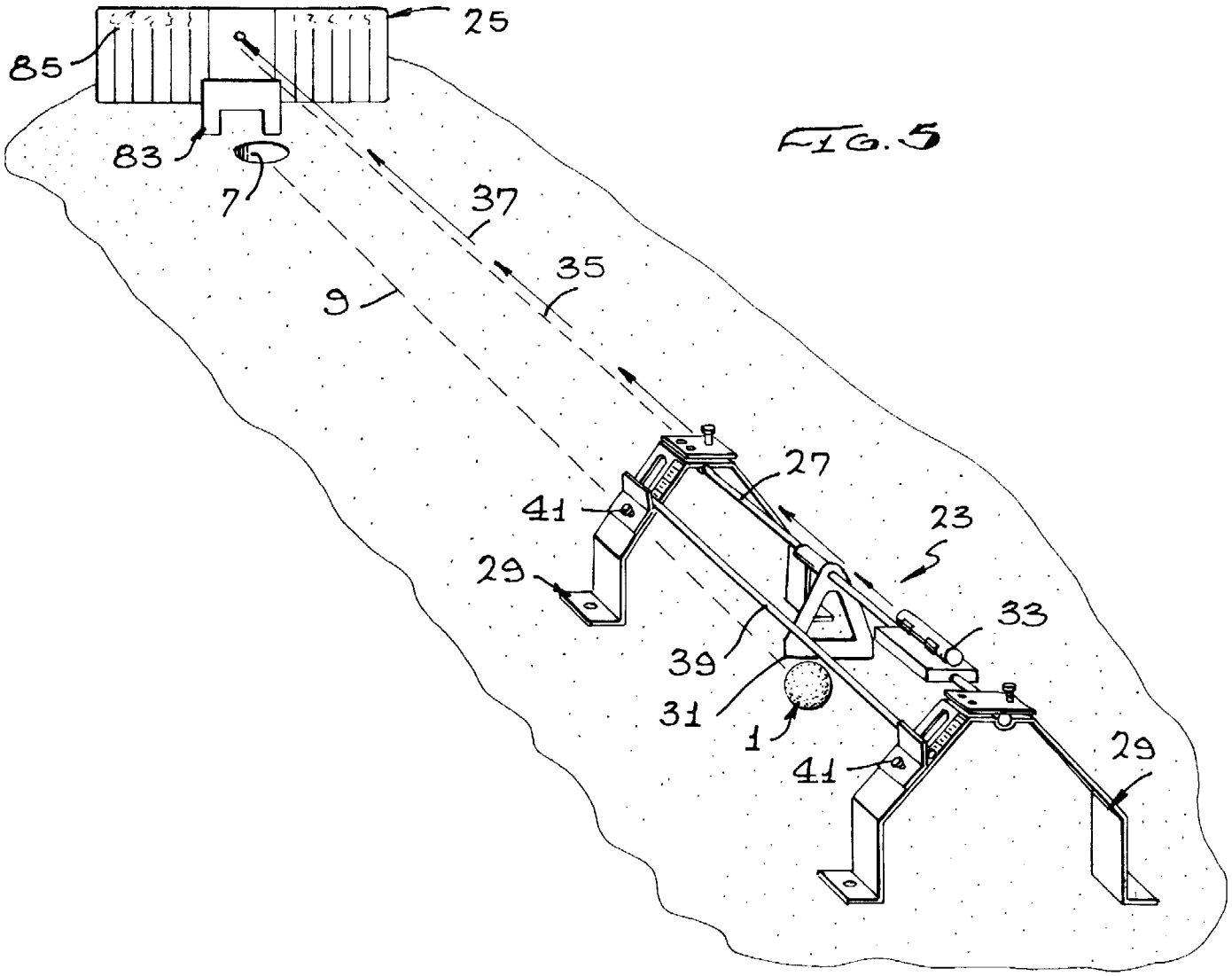
FIG. 5 shows a preferred embodiment of the invention in use, with the preferred embodiment including a visual targeting aid at the cup.

The first skill involves the ability to accurately define a sight line from the ball towards the cup. This line may go directly to the cup, or more typically, will be directed slightly away from the cup to allow for breaking of the ball. A direct sight line 9 is shown in FIG. 5, where a preferred embodiment of the present invention is shown in use. In this figure, a golf ball 1 is positioned several feet away from the cup 7, and an imaginary sight line 9 is defined between the ball 1 and the cup 7. The practice putting device 23 is placed over the ball 1 so that the sight rod 27 and the sight line 9 are in the same vertical plane. Once the device is positioned, the correctness of the alignment may be checked by activating the laser 33. The laser beam 37 is also in the same vertical plane as the sight line 9, so will create a visible mark on the sighting target 25 in the same vertical plane as the sight line 9. Alternatively, the golfer can stand behind the practice putting device 23 and sight down the sight rod 27. The sight rod line 35 thus created should also be in the vertical plane containing the sight line 9. Those skilled in the art will recognize several alternative methods to assure that the practice putting device 23 is properly aligned. If not properly aligned, the practice putting device 23 may be adjusted until the sight line 9, the laser beam 37 and the sight rod line 35 are all in the same vertical line. With practice, the golfer will become proficient at accurately defining the imaginary sight line 9 without activating the laser 33 or sighting down the sight rod 27.

The next necessary skill is to correctly address the ball. Here, golfers try to keep their eyes directly above the ball 1. Using the practice putting device 23, the golfer first assures that the practice putting device 23 is properly aligned as discussed above. Then, the golfer moves the square face indicator 31 so it is aligned just behind the ball 1. The golfer then assumes a putting position, looking downward at the ball. The golfer is assured to be directly above the ball if the sight rod appears in the exact center of the ball 1, and the back of the ball I appears tangential to the front of the square face indicator 31. With practice, the golfer will become proficient at addressing the ball correctly. Also, a golfer should continue to look at the original ball position until the follow-through is completed. This is an especially difficult skill to learn, but the practice putting device 23 assists in this effort by giving the golfer something to concentrate on. Thus, by focusing on the square face indicator 31 even after the ball has been struck, golfers may keep their eyes properly fixed and avoid looking up and possibly ruining the putt.

The next skill involves properly squaring the putter face to the ball 1. Once the golfer has properly aligned the practice putting device 23 and can consistently correctly address the ball, the golfer positions the putter head just behind the ball. FIG. 3 shows what the golfer sees when properly addressing the ball. Here the golfer sees a putter head 3*a*, with the putter face 3*d* positioned just behind the ball 1. The square face indicator 31 is positioned just behind the ball also, and has an indicator flange 59 that protrudes and is brightly colored for ease of viewing. This flange, if the practice putting device 23 is properly aligned, will be square to the imaginary line 9. Thus, by aligning the putter face 3*d* to the flange 59, the putter face will be square to the imaginary line 9. Even during the stroke, the golfer will be able to clearly identify even a slight variation from square.

Once the putter face is squared, the golfer must take the stroke, assuring that the shaft moves parallel to the sight line 9. To assure that the entire stroke, from take-away to follow-through, is square, the practice putting device 23 includes a shaft guide rod 39. The shaft guide rod 39 is supported at an elevation of lower than the sight rod by the guide rod clips 41, which are thumb-screwed to a slot 43 in the stands 29. Since the shaft guide rod 39 is so attached, it may be easily moved on the stand 29, thus allowing the shaft guide rod 39 to adjust for putter shafts coming in at different angles and for accommodating differing putter styles, putting techniques, and golfer height. To take a stroke, the golfer contacts the putter shaft to the shaft guide rod 39 for the entire stroke. By practicing in this manner, golfers train their bodies to feel and eventually replicate the proper parallel stroke. As the golfer becomes more proficient at the stroke, the shaft guide rod 39 may be simply lifted from the supports and set aside, allowing the golfer to practice the stroke unaided. With some putter designs, the golfer may need to push the square face indicator 31 away from the golf ball before taking the stroke.

The preferred embodiment, then, allows the golfer to concentrate practice or instruction effort on just one skill at a time, advancing to the next skill and combining skills as confidence and ability increase. Such a modular approach to instructing and practicing putting should make putting practice time as efficient as possible. We now address the preferred embodiment with more specifics.

Figure 6:
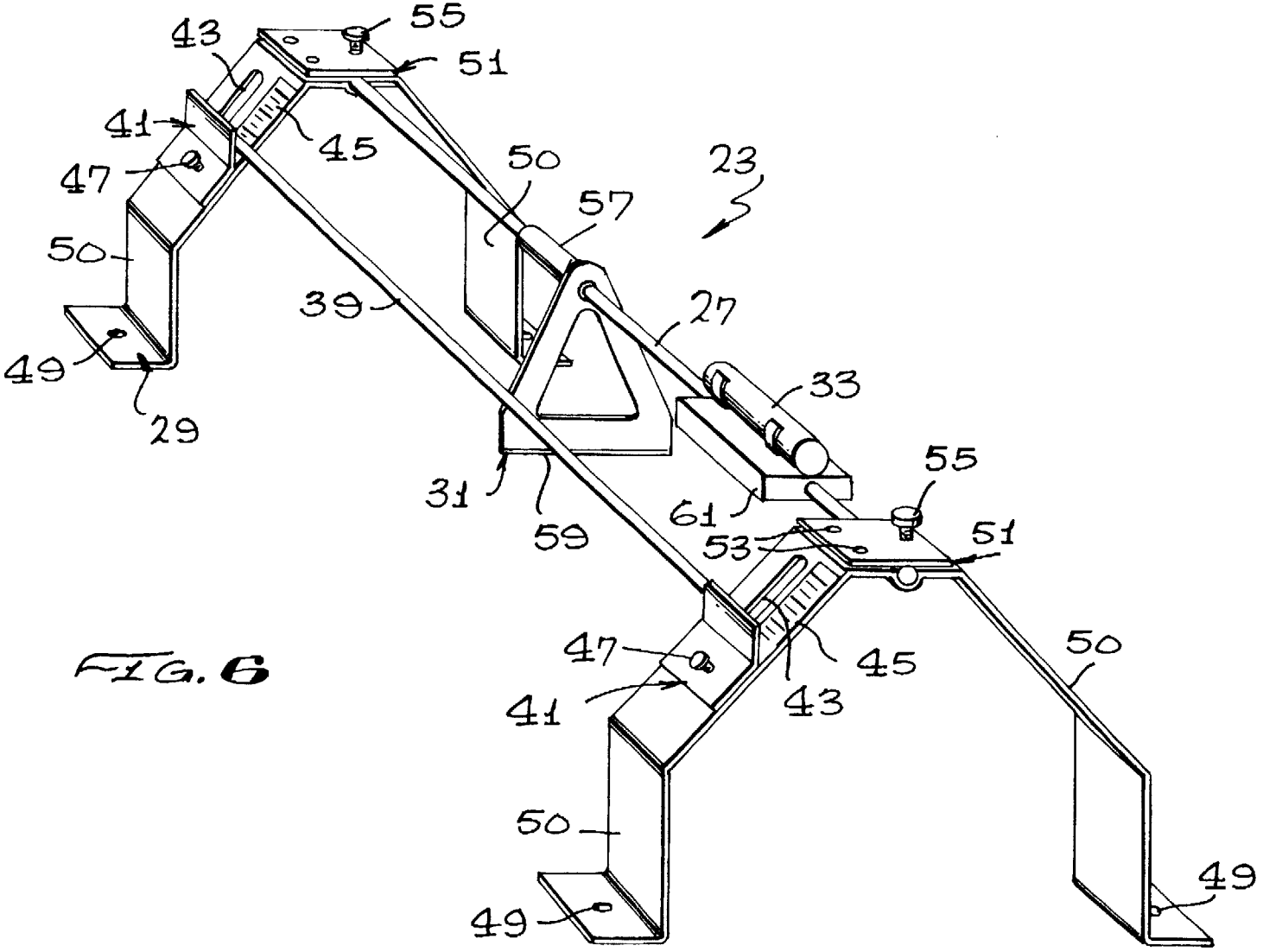
FIG. 6 shows a practice putting device of the preferred embodiment.

FIG. 6 shows the practice putting device 23. This device comprises two aluminum stands 29 having legs 50 with stand securement holes 49 allowing the device to be secured to a surface. The stands 29 are shown in a side view, front view, and top view in FIGS. 7*a*, 7*b*, and 7*c* respectively. The stands are sized to allow the sight rod 27 to be positioned approximately 5 inches above the ground surface, with the legs 50 set apart to allow sufficient support and a golf ball to easily roll between. In the preferred embedment the legs 50 are split by approximately 6 inches. The legs, starting at the ground surface, have about a 1 inch flat area or base where the stand securement holes 49 are located, rise vertically for about 2½ inches, then angle in at about 45 degrees until they flatten out for approximately the last inch. The shape of the stand is generally symmetrical about its vertical centerline, but some differences will soon be noted. The front face of the stand contains an aluminum guide clip slot 43 approximately 2½ inches long and positioned in the center of the angled portion of a leg 50. The top of the stand 29 has 3 holes: 2 sight rod clamp screw holes 63 and 1 sight rod clamp thumbscrew hole 65. The thumbscrew hold 65 is located on the top flat portion of the leg 50 with the guide clip slot 43, and the 2 sight rod clamp screw holes 63 are located on the top flat portion of the leg without the guide clip slot. The sight rod 27 is 3/16 inches in diameter, 36 inches long, and composed of stainless steel. It is attached to the stands 29 with the sight rod clamps 51. The top of the stand contains a small rounded indentation that assists in securing the sight rod 27. The sight rod clamp 51 is attached to the stand with 2 sight rod clamp screws 53 that secure to the sight rod clamp screw holes 63. Additionally, a sight rod clamp thumbscrew 55 assists in securing the sight rod clamp 51 to the stand 29 by screwing into the sight rod clamp thumb screw hole. The sight rod clamp screw holes and sight rod thumbscrew holes are all tapped to accept the corresponding screw or thumbscrew threads.

The guide clips 41 are slidably attached to the guide clip slots 43, and are shown in a front view, bottom view, and side view in FIGS. 11*a*, 11*b*, and 11*c* respectively. FIG. 11 *d* shows the guide clip nut plate 79. Each guide clip 41 has two guide clip aligners 75 to assist in assuring the guide clip 41 remains square to the leg 50; a guide clip flange 73 that supports the sight rod 27; and a guide clip bolt hole 77. The guide clip 41 is place with the guide clip stand aligners positioned about the leg 50, and the guide clip thumbscrew 47 extends into the guide clip bolt hole 77, through the leg 50, and threads into the guide plate nut 81, which is tapped into the guide clip nut plate 79. The shaft position indicator 45, shown in more detail in FIG. 10, is then attached adjacent to the guide clip slots 43. The shaft guide rod, also a 3/16 inch diameter, 36 inch long stainless steel rod, is set to rest against the guide clips 41.

The aluminum square face indicator 31 is attached to the sight rod with the square face indicator hub 57. FIG. 8*a* shows a side view of the square face indicator, with FIG. 8*b* showing a front view, which includes the attached square face indicator hub 57. The square face indicator is substantially an isosceles triangle, with the base at the bottom. The square face indicator 31 is sized so when the device is in use, the square face indicator flange 59 is above the top surface of the golf ball. This square face indicator flange 59 is formed from approximately 1/16 inch of the bottom of the square face indicator 31, thus creating a more visible surface from which to align the putter face. For additional ease of viewing, the square face indicator flange 59 may be coated or painted with a bright color.

The square face indicator hub is turned from stainless steel and is key to the proper alignment of the putter face. Because a very small misalignment will lead to a large error on longer putts, it is important that the square face indicator be as nearly squared to the sight rod as possible. A front and side view of the square face indicator hub 57 are shown in FIGS. 8*c* and 8*d* respectively. The square face indicator hub 57 comprises a square face sight rod hole 69, into which the sight rod 27 is placed, a threaded square face thumbscrew hole 67 for using a thumbscrew, and a square face squaring area 71 to assure the square face indicator is properly squared. The square face squaring area 71 is milled perpendicular to the square face sight rod hole 69 to within 0.005 inch total indicated runout. This means the maximum misalignment error is 0.005 inches per inch of milled area. Thus, in a 10 foot (120 inches) putt, a surface milled to the maximum allowable tolerance will be misaligned by only about ½ inch. Since a cup is 4½ inches in diameter, this is an acceptable amount of error. The square face indicator is permanently staked to the square face indicator hub 57 with a 90 degree center punch tool, and the combined unit slipped onto the sight rod 27. A thumbscrew is threaded into the square face thumbscrew hole to assist in securing the square face indicator 31 onto the sight rod 27.

The laser pointer 33 is attached to the sight rod 27 with the laser pointer holder 61. The laser pointer 33 is a standard commercially available device commonly used for giving group presentations, and has a small toggle push-button for activation on the top of the lateral side. The particular laser pointer 33 for the preferred embodiment is the TSP200 from Lyte Optronics company. This laser pointer is placed in the custom aluminum laser pointer holder 61, which is shown in top view in FIG. 14*a* and front view in FIG. 14*b*. The laser pointer holder 61 slides onto the sight rod 27 via the hub sight rod hole 62, and is held in place by two thumbscrews that thread into the hub thumbscrew holes 64. The laser pointer 33 slides into the laser channel 60 with the push-button on/off switch positioned toward the top. The laser pointer 33 naturally self-secures into the laser channel 60 through its tapering. The laser pointer is activated by simply rotating the laser pointer approximately 60 degrees in either direction, with the push-button engaging the side of the laser pointer holder 61, thus activating the laser. The laser pointer is deactivated by simply rotating the laser pointer so the push-button is near the original vertical position.

Referring back to FIG. 5, the sighting target 25 is used to assist in verifying the placement of the practice putting device 23. The sighting target 25 comprises the sight stand 83 and the sight target 85. The sight stand, shown in a side view in FIG. 12*a* and a front view in FIG. 12*b*, is held in the ground with the stainless steel sight stand posts 87, which are shown in FIG. 12*c*. The top of the sight stand 83 has a slot extending its entire length. The slot is sized to allow the insertion of the sight target 85. The sight stand posts 87 are slidably inserted into the sight stand post holes 89, thus allowing the sight stand to be used on surfaces that could not be penetrated by the sight stand posts 87. Also, the sighting target 85 may be removed from the sight stand 83 and mounted independently for use where it is not possible to insert the sight stand posts into the surface.

The sight target 85 is shown in more detail in FIGS. 13*a* and 13*b*. One side of the sight target 85 is graduated in inches, as shown in FIG. 13*a*, and one side is graduated in golf-ball diameters. A golfer may choose between the two distance measuring modes by simply removing the sight target 85 from the sight stand 83 and turning it around. Those skilled in the art will recognize several alternatives to these distance indication methods. The sight stand 83 is made from a UHMW white plastic, and the sight target 85 is made from a ridged foam PVC material. For optimum viewing of the laser beam, the sight target 25 is red with white lettering and graphics.

While embodiments and applications of this invention have been shown and described, it would be apparent to those in the field that many more modifications are possible without departing from the inventive concepts herein. The invention, therefore, is not to be restricted except in the spirit of the appended claims.

What is claimed is:

1. An instructional device for putting a golf ball with a putter, comprising:

a first and a second stand each having a top, a side, and a base;

a sight rod having two ends, with one end attached to the top of the first stand laterally of said base and the other end attached to the top of the second stand laterally of said base so that the sight rod is adapted to be positioned directly above the golf ball and the head of the putter and a golf ball may be putted along the line of said sight rod to a target remote from said device; and a square face indicator operably communicating to the sight rod and positioned perpendicular to the sight rod.

2. The device of claim 1 further comprising a shaft guide having two ends, with one end coupled to the side of the first stand and the other end coupled to the side of the second stand, wherein the shaft guide is at an elevation lower than and parallel to the sight rod and positionable to support the shaft of the putter.

3. The device of claim 2 where the shaft guide is removable.

4. The device of claim 1 where the square face indicator is slidably attached to the sight rod.

5. An instructional device for putting a golf ball with a putter, comprising:

a first and a second stand each having a top and a side;

a sight rod having two ends, with one end attached to the top of the first stand and the other end attached to the top of the second stand, wherein the sight rod is positioned directly above the golf ball and the head of the putter;

a shaft guide having two ends, with one end coupled to the side of the first stand and the other end coupled to the side of the second stand, wherein the shaft guide is at an elevation lower than and parallel to the sight rod and positionable to support the shaft of the putter.

6. The device of claim 5 where the shaft guide is removable.

* * * * *